US009216308B2

(12) United States Patent
Cordani

(10) Patent No.: US 9,216,308 B2
(45) **Date of Patent: *Dec. 22, 2015**

(54) METHOD OF EXTINGUISHING UNDERGROUND ELECTRICAL FIRES

(71) Applicant: GelTech Solutions, Inc., Jupiter, FL (US)

(72) Inventor: Peter Cordani, Palm Beach Gardens, FL (US)

(73) Assignee: GelTech Solutions, Inc., Jupiter, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/309,192

(22) Filed: Jun. 19, 2014

(65) Prior Publication Data

US 2014/0299337 A1 Oct. 9, 2014

Related U.S. Application Data

(62) Division of application No. 13/289,425, filed on Nov. 4, 2011, now Pat. No. 8,757,280.

(51) Int. Cl.

| | |
|---|---|
| ***A62C 3/16*** | (2006.01) |
| ***A62C 3/02*** | (2006.01) |
| ***A62C 3/00*** | (2006.01) |
| ***A62D 1/00*** | (2006.01) |
| ***A62C 99/00*** | (2010.01) |

(Continued)

(52) U.S. Cl.

CPC ..... *A62C 3/16* (2013.01); *A62C 3/0221* (2013.01); *A62C 5/008* (2013.01); *A62C 99/0009* (2013.01); *A62C 5/002* (2013.01); *A62C 5/02* (2013.01)

(58) Field of Classification Search

CPC ..... A62C 3/0221; A62C 3/16; A62C 5/002; A62C 5/008; A62C 5/02; A62C 5/033; A62C 99/0009

USPC ..... 169/14, 15, 43, 44, 46, 47, 54, 64, 69, 169/70; 252/2, 3, 8.05

See application file for complete search history.

(56) References Cited

U.S. PATENT DOCUMENTS

| | | | |
|---|---|---|---|
| 3,583,490 | A | 6/1971 | McFadden |
| 4,330,040 | A | 5/1982 | Ence et al. |

(Continued)

FOREIGN PATENT DOCUMENTS

| | | |
|---|---|---|
| DE | 19945753 | 4/2001 |
| JP | 2010098814 | 4/2010 |

*Primary Examiner* — Darren W Gorman

(74) *Attorney, Agent, or Firm* — McHale & Slavin, P.A.

(57) ABSTRACT

A unique method for suppressing the spread of and extinguishing underground electrical fires in confined areas such as tunnels and conduits. A super absorbent polymer is mixed with water to form a hydrated super absorbent polymer and this admixture is applied to an electrical fire. The admixture has superior fire suppression and extinguishing properties than the fire suppression and extinguishing properties of plain water. The admixture has the ability to cling to the object(s) to which it has been applied and both cool down the object(s) and block the fire from reaching the object(s). The super absorbent polymer and water admixture also encapsulates the noxious and toxic gases produced by electrical fires and prevents the release of these toxic gases into the atmosphere. Finally, the super absorbent polymer and water mixture retains the ash, particulates, and other byproducts of the electrical fire to enable a thorough cleanup.

6 Claims, 8 Drawing Sheets

(51) Int. Cl.
*A62C 5/00* (2006.01)
*A62C 5/02* (2006.01)

(56) References Cited

U.S. PATENT DOCUMENTS

| | | | | |
|---|---|---|---|---|
| 4,384,988 | A | 5/1983 | Schoenholz et al. | |
| 4,978,460 | A | 12/1990 | Von Blucher et al. | |
| 5,087,513 | A | 2/1992 | Kim | |
| 5,190,110 | A | 3/1993 | von Blucher et al. | |
| 5,519,088 | A | 5/1996 | Itoh et al. | |
| 5,849,210 | A | 12/1998 | Pascente et al. | |
| 5,989,446 | A | 11/1999 | Hicks et al. | |
| 6,161,699 | A | 12/2000 | Gartland | |
| 6,167,971 | B1 | 1/2001 | Van Lingen | |
| 6,371,384 | B1 | 4/2002 | Garcia | |
| 6,372,842 | B1 | 4/2002 | Grisso et al. | |
| 6,450,264 | B1 | 9/2002 | Christian | |
| 6,679,337 | B1 | 1/2004 | Perry et al. | |
| 6,834,728 | B2 | 12/2004 | Demole | |
| 6,841,125 | B1 | 1/2005 | Chartier et al. | |
| 6,929,072 | B2 | 8/2005 | Brown | |
| 6,945,468 | B1 | 9/2005 | Rodriguez et al. | |
| 7,096,965 | B2 | 8/2006 | Ozment | |
| 7,104,336 | B2 | 9/2006 | Ozment | |
| 7,124,834 | B2 | 10/2006 | Sundholm et al. | |
| 7,169,843 | B2 | 1/2007 | Smith et al. | |
| 8,003,001 | B1 * | 8/2011 | Kaiser et al. | 252/2 |
| 2005/0150664 | A1 | 7/2005 | Miller et al. | |
| 2006/0157668 | A1 | 7/2006 | Erdner et al. | |
| 2008/0035354 | A1 | 2/2008 | Cordani | |
| 2008/0229969 | A1 * | 9/2008 | Green et al. | 106/16 |
| 2009/0056957 | A1 * | 3/2009 | Cordani | 169/15 |
| 2012/0193108 | A1 | 8/2012 | Cordani | |

* cited by examiner

METHOD OF EXTINGUISHING UNDERGROUND ELECTRICAL FIRES

CROSS REFERENCE TO RELATED APPLICATIONS

In accordance with 37 CFR 1.76, a claim of priority is included in an Application Data Sheet filed concurrently herewith. Accordingly, the present invention claims priority as a divisional of U.S. patent application Ser. No. 13/289,425, entitled "METHOD OF EXTINGUISHING UNDERGROUND ELECTRICAL FIRES", filed Nov. 4, 2011. The contents of the above referenced application is incorporated herein by reference in its entirety.

FIELD OF THE INVENTION

This invention relates to the field of fire prevention, and more particularly to a method of using a dehydrated super absorbent polymer in combination with a source of water to extinguish electrical fires. More specifically, this invention describes a method of extinguishing and suppressing the rekindling of electrical fires in underground locations, such as underground utility conduits in cities, by the application of an admixture of super absorbent polymer and water.

BACKGROUND OF THE INVENTION

In many cities the utilities are located beneath the surface of the earth, usually beneath the surface of the streets. These utilities are usually placed in tunnels or conduits. In the older cities, such as New York City, these utilities have been located in these tunnels or conduits for many years/decades. Over time, the conduits which carry these utilities wear out and break. For example, water main breaks are a well known example of a utility conduit failing. Another serious problem is the failure of electrical transmission lines in conduits and tunnels. These failures usually result in fires which must be quickly extinguished to prevent further damage.

While it is desirable to replace very old utilities in conduits and tunnels, it is not always practical. Recently, a new tunnel for the supply of water was built under New York City. This was a tremendous project which took many years to complete and was very expensive. The replacement of the electrical transmission lines under the streets of New York City should also occur. However, due to financial restraints and other limitations, these electrical transmission lines have not been replaced. Thus, these old electrical transmission lines break down or fail which results in electrical fires. These fires are commonly seen as smoke coming from manhole covers in the streets and sidewalks of a city. It has been estimated by Consolidated Edison that there are approximately 40 electrical fires per day under the streets of New York City.

The cost of repairing and replacing the electrical transmission lines damaged by these fires is approximately $100,000.00 per linear foot of transmission line. Therefore, it is imperative that these fires be extinguished as quickly as possible. Normally, when there is a fire, the firefighters locate the fire and call the utility to cut off the electrical power to that section of the electrical transmission line so that the fire can be extinguished with water. Because of the large voltage and current sent through these transmission lines, the application of water to these lines without the power being turned off would result in the instant electrocution of the firefighter. Accordingly, the firefighters wait until there is no doubt that all the electrical power has been turned off in the transmission lines they are about to extinguish. This, of course, results in the fire burning for an unnecessary extra amount of time and having the utility incur an unnecessary financial expense.

Once it has been established that the electrical power has been turned off, the firefighters enter the underground tunnel or conduit through a manhole and apply large amounts of water onto the electrical transmission lines which are on fire and/or smoldering until they determine that the fire has been completely extinguished and will not flare-up or restart. This large amount of water usually results in the destruction of good electrical transmission lines that are not involved in the fire. The water also fails to suppress the toxic gases produced by the burning electrical insulation, wires, and electrical components.

After the fire has been extinguished, the area must be cleaned up and the residue from the fire removed. Normally, a clean-up crew enters the tunnel or conduit to vacuum up the water, particulate ash from the burnt components and other residue produced by the fire. This is a costly operation. Finally, after the clean-up crew has completed its job, a crew of electricians enters the tunnel or conduit to replace the electrical transmission lines and other equipment which has been destroyed/damaged by the fire with new equipment/components.

DESCRIPTION OF THE PRIOR ART

U.S. Pat. No. 6,834,728 discloses a system for extinguishing a fire in a tunnel. The system includes a conduit for delivering a fire extinguishing liquid and a trough extending parallel to the conduit for receiving liquid from the conduit. A carriage is arranged to move on a track which includes an upper edge of the trough. The carriage carries a pump having a nozzle, a video camera, and an inlet; each of which can be controlled robotically from a remote control station. The inlet is deployed in the trough to draw liquid from the trough.

U.S. Pat. No. 7,096,965 discloses a method of proportioning a foam concentrate into a non-flammable liquid to form a foam concentrate/liquid mixture and create a flowing stream of the foam concentrate/liquid mixture. Nitrogen is introduced into the stream of the foam/liquid mixture to initiate the formation of a nitrogen expanded foam fire suppressant. The flowing stream carrying the nitrogen expanded foam is dispensed, which completes the full expansion of the nitrogen expanded foam fire suppressant, into the confined area involved in the fire, thereby smothering the fire and substantially closing off contact between combustible material involved in the fire and the atmosphere. This substantially reduces the danger of explosion or flash fires. The apparatus of this invention is adapted for expanding and dispensing foam and includes a housing defining an interior through which extends a discharge line. The ends of the housing are closed about the ends of the discharge line, and the ends of the discharge line extend beyond the ends of the housing to define a connector at one end for receiving a stream of foam concentrate/liquid and at the opposite end to define the foam dispensing end of the apparatus. A portion of the discharge line in the housing defines an eductor for the introduction of expanded gas into the stream of foam concentrate/liquid flowing through the discharge line.

U.S. Pat. No. 7,104,336 discloses a method and apparatus for proportioning a foam concentrate into a non-flammable liquid to form a foam concentrate/liquid mixture and create a flowing stream of the foam concentrate/liquid mixture similar to the method and apparatus of U.S. Pat. No. 7,096,965. The present patent also includes an optional power generator which can be added to the system for instances where power is not readily available.

U.S. Pat. No. 7,124,834 discloses a method for extinguishing a fire in a space such as a tunnel. The method includes spraying a fire extinguishing medium into the space by spray heads. In a first stage of the method, the flow and temperature of the hot gases produced by the fire are influenced by spraying an extinguishing medium into the space, especially by creating in the space at least one curtain of extinguishing medium. At least some spray heads in the space are pre-activated into a state of readiness. In a second stage of the method, at least one spraying head is activated to produce a spray of extinguishing medium.

U.S. patent application Ser. No. 11/680,803 is entitled "Process for Fire Prevention and Extinguishing", the contents of which are incorporated herein by reference. In this application, a process for retarding or extinguishing conflagrations using a super absorbent polymer in water is disclosed. The reaction of the water with the polymer creates a gel-like substance with a viscosity that allows the mixture to be readily pumped through a standardized 2.5 gallon water based fire extinguisher, yet viscous enough to cover vertical and horizontal surfaces to act as a barrier to prevent fire from damaging such structures, minimizing the manpower needed to continuously soak these structures.

U.S. Pat. No. 7,169,843 discloses absorptive, cross-linked polymers which are based on partly neutralized, monoethylenically unsaturated monomers carrying acid groups, and with improved properties, which has a high gel bed permeability and high centrifuge retention capacity.

U.S. Pat. No. 5,989,446 discloses a water additive for use in fire extinguishing and prevention. The additive comprises a cross-linked water-swellable polymer in a water/oil emulsion. The polymer particles are dispersed in an oil emulsion wherein the polymer particles are contained within discrete water "droplets" within the oil. With the help of an emulsifier, the water "droplets" are dispersed relatively evenly throughout the water/oil emulsion. This allows the additive to be introduced to the water supply in a liquid form, such that it can be easily educted with standard firefighting equipment.

U.S. Pat. No. 5,190,110 discloses the fighting of fires or protection of objects from fire by applying water which comprises dispersing in the water particles of a cross-linked, water-insoluble, but highly water-swellable, acrylic acid derivative polymer in an amount insufficient to bring the viscosity above 100 mPa's. Advantageously, the particles are present in an amount such that, after swelling, the swollen particles hold 60 to 70% by weight of the total water; the polymer being a copolymer of an acrylic acid, the water containing silicic acid and/or a silicate as well as sodium, potassium or ammonium ions. The water is freely pumpable, but the swollen particles adhere to surfaces they contact rather than running off rapidly.

U.S. Pat. No. 5,849,210 discloses a method of preventing or retarding a combustible object from burning including the steps of mixing water with a super absorbent polymer ("SAP") to form one at least partially hydrated SAP, and applying the at least partially hydrated SAP to the combustible object, before or after combustion. In another embodiment, an article of manufacture includes a SAP that is prehydrated and is useful for preventing a combustible object from burning, or preventing penetration of extreme heat or fire to a firefighter or other animal.

U.S. Pat. No. 6,372,842 discloses methods of using an aqueous composition or dispersion containing a water-soluble or water-dispersible synthetic polymer, and compositions formed thereof. The aqueous composition or dispersion is added to agricultural spray, ink, deicing, latex paint, cleaner and fire-extinguishing chemical compositions, water-based hydraulic compositions, dust control compositions and so on, to impart properties including, but not limited to, aerosol control, shear stability, transfer efficiency, oil/water reduction, emollient performance, lubricity, thickening, and anti-wear capability, to the resultant composition formed thereof.

U.S. Pat. No. 5,087,513 discloses polybenzimidazole polymer/superabsorbent polymer particles. These articles are prepared by either mixing the super absorbent polymer particulates with the polybenzimidazole polymer solution during the formation of the polybenzimidazole article, or forming a composite of a polybenzimidazole film or fiber material layer with a super absorbent polymer particulate containing layer. These polybenzimidazole products absorb large amounts of fluid while retaining the flame retardancy and chemical unreactivity of conventional polybenzimidazole materials.

U.S. Pat. No. 4,978,460 discloses a particulate additive for water for fire fighting containing a strongly swelling water-insoluble high molecular weight polymer as gelatinizing agent, which comprises a water-soluble release agent which causes the particles of said gelatinizing agent not to swell, the particles of the gelatinizing agent being encased or dispersed in the release agent. Suitable release agents include polyethylene glycol, sugars, mannitol, etc. The gelatinizing agent may be a moderately cross-linked water-insoluble acrylic or methacrylic acid copolymer.

U.S. Pat. No. 5,519,088 discloses an aqueous gel comprising a polymer of (meth)acrylamide or particular (meth)acrylamide derivative(s), particulate metal oxide(s) and an aqueous medium, a process for producing said gel, and products utilizing said gel. This aqueous gel can be produced so as to have transparency, be highly elastic and fire resistant and can prevent the spreading of flames. The aqueous gel when produced transparent, becomes cloudy when heated or cooled and is useful for the shielding of heat rays or cold radiation.

SUMMARY OF THE INVENTION

A unique method for suppressing the spread of and extinguishing electrical fires in confined areas such as underground tunnels and conduits is disclosed. The new method includes mixing a super absorbent polymer with water to form a hydrated super absorbent polymer and applying this admixture to an electrical fire. The super absorbent polymer and water admixture has substantially superior fire suppression and extinguishing properties than the fire suppression and extinguishing properties of plain water. One of the unique properties of the admixture is its ability to cling to the object(s) to which it has been applied and both cool down the object(s) after it is on fire and block the fire from reaching the object(s). The admixture also has a viscosity which enables it to be contained with a specific area without spreading to adjacent areas. These superior properties enable electrical fires to be extinguished more rapidly and not flare back up. The super absorbent polymer and water admixture also encapsulates the noxious and toxic gases produced by electrical fires and prevents the release of these toxic gases into the atmosphere. Finally, the super absorbent polymer and water mixture retains the ash, particulates, and other byproducts of the electrical fire to enable a rapid and thorough cleanup.

Accordingly, it is an objective of the present invention to provide a unique method of extinguishing fires and suppressing the spread of fires in confined areas.

It is a further objective of the present invention to provide a unique method of extinguishing electrical fires and suppressing the spread of electrical fires in underground tunnels and conduits.

It is yet another objective of the present invention to provide a unique method of extinguishing electrical fires and suppressing the spread of electrical fires which utilizes substantially less water, resulting in less damage to electrical components and other equipment located in the vicinity of the fire.

It is still yet another objective of the present invention to provide a unique admixture of super absorbent polymer and water which has viscosity sufficient to enable it to not flow readily and retain a shape for a period of time. The viscosity also enables the admixture to adhere to horizontal, vertical, inclined, and curved surfaces.

It is a still further objective of the present invention to provide a unique method of suppressing the spread of and extinguishing electrical fires which enables the fires to be extinguished more rapidly.

It is a still further objective of the present invention to provide a unique method of extinguishing electrical fires and suppressing the spread of electrical fires which prevents the escape of noxious and toxic gases into the atmosphere.

It is a still further objective of the present invention to provide a unique method of extinguishing electrical fires and suppressing the spread of electrical fires which results in a rapid and less expensive cleanup process.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1A:
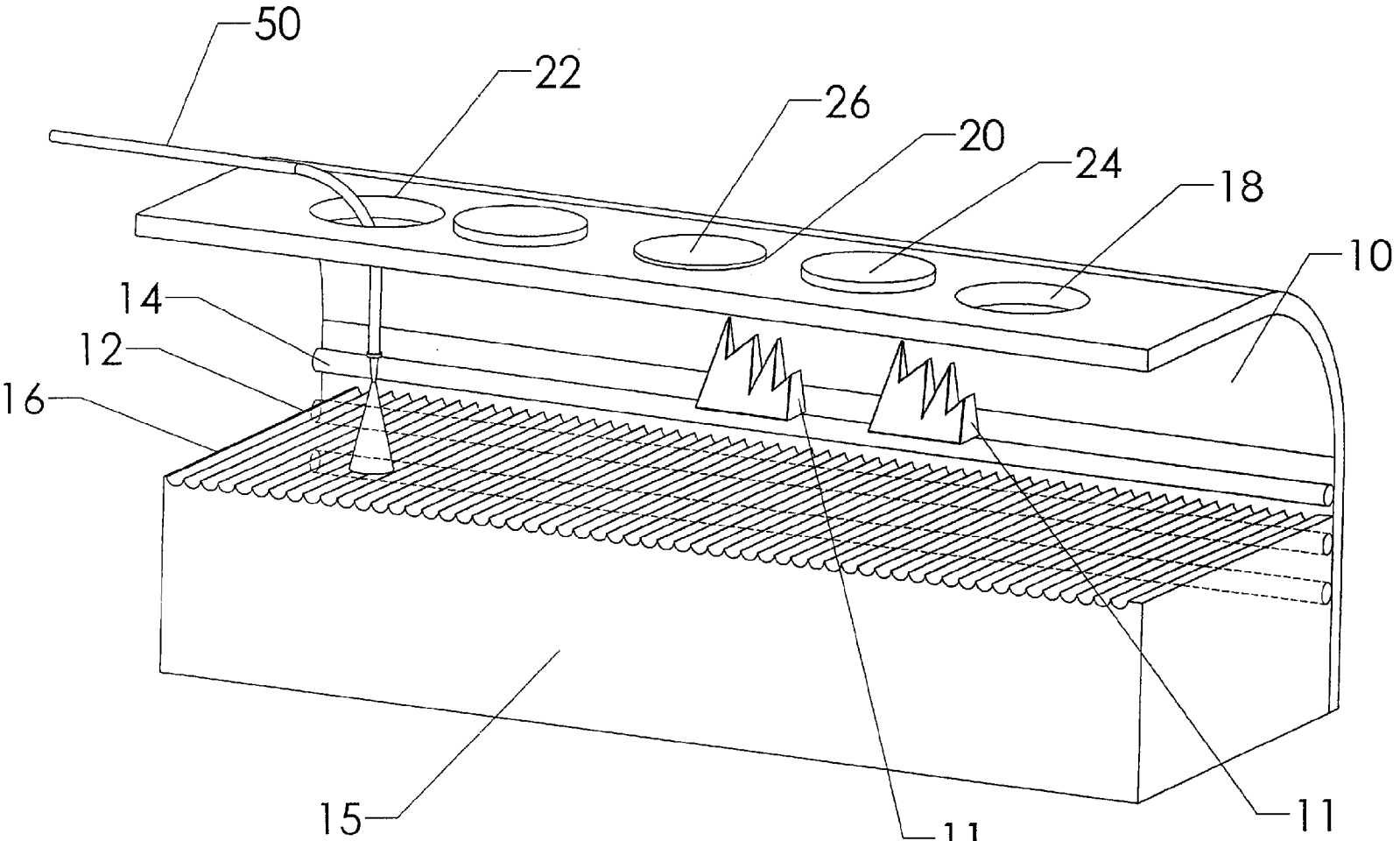
FIG. 1A is an illustration of a method of fighting an electrical fire in an underground tunnel or conduit employing an admixture of the present invention.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

The present invention relates to a unique technique or method of extinguishing electrical fires and suppressing the spread of electrical fires. This unique technique utilizes a super absorbent polymer in water in an amount sufficient to extinguish an electrical fire and suppress the spread of the electrical fire. The present invention utilizes biodegradable, super absorbent, aqueous based polymers. Examples of these polymers are cross-linked modified polyacrylamides/potassium acrylate or polyacrylamides/sodium acrylate. Other suitable polymers include, albeit not limited to, carboxymethylcellulose, alginic acid, cross-linked starches, and cross-linked polyaminoacids.

FIGS. 1-7, which are now referenced, illustrate the present invention which relates to a new and unique method of suppressing the spread of and extinguishing electrical fires. Electrical fires present different and unique problems pertaining to how these fires should be extinguished and suppressed. Water is normally used to fight fires because is can quickly cool down the burning material, there is usually a large supply of it ready for use, and it is relatively inexpensive. However, water and electricity are harmful, if not deadly to individuals, when brought into contact with each other. Normally, when water hits an active electrical circuit or electrical component, it shorts out the circuit or component, which usually results in destruction of the circuit or component. Further, when individuals are in close proximity to the water contacting the electricity, there is a strong likelihood that the water will act as a conductor and conduct the electricity to the individuals, resulting in serious injury or death of the individuals. Since water spreads rapidly in all directions on surfaces, electricity which comes in contact with the water will be conducted to wherever the water flows. Because it is difficult to prevent water from flowing to certain areas, there is a strong likelihood that individuals will be injured or killed when they come in contact with this water.

In the preferred embodiment of the present invention, a solid form of the super absorbent polymer, such as a powder, is added to a stream or body of water which results in an aqueous admixture of the super absorbent polymer and water having properties which enable the super absorbent polymer and water admixture to be applied to an area and remain within the confined area because of its relatively high viscosity. The properties of the admixture, in particular its viscosity, also enable the admixture to be applied to and remain on vertical, horizontal, and curved surfaces of objects which are on fire or are capable of catching on fire. The present invention adds a predetermined amount of the super absorbent polymer to a predetermined amount of water to obtain an admixture which has properties that enable the admixture to suppress the spread of an electrical fire and extinguish the electrical fire. The preferred predetermined amounts are 5-8 pounds of dry super absorbent polymer to 100 gallons of water. The size of the dry super absorbent polymer is preferably less that 5 microns in diameter, and the most preferred size of the dry super absorbent polymer is 3 microns in diameter. The super absorbent polymer can be added to a given volume of water and the resulting admixture pumped to a location to suppress the spread of and extinguish electrical fires. The adherence of the admixture of super absorbent polymer and water to the surface of an object lowers the temperature of the object below the combustion temperature of the object, thereby extinguishing the fire. In addition, adherence of the admixture of super absorbent polymer and water to the surface of an object maintains moisture content at a level which suppresses the spread of the fire by preventing combustion of the object from hot embers and/or flames.

Currently, the firefighters apply water to the electrical conduits/components which are on fire and also to adjacent conduits/components because it is difficult to control where the water goes. This contact of water on electrical conduits/components that are not on fire results in substantial unnecessary damage to these conduits/components. The present invention, on the other hand, enables the firefighter to direct the super absorbent polymer water mixture to a specific area containing electrical components. The mixture then adheres to that area within the conduit/component without affecting adjacent conduits/components. Thus, a substantial financial savings is gained by the present invention because electrical conduits/components which are not on fire are not damaged by water. It has been estimated that in a large city such as New York City the cost of repairing/replacing damaged underground electrical conduits/components is approximately $100,000.00 per linear foot. Therefore, by avoiding applying the water on adjacent electrical components a substantial financial savings can be achieved.

Another disadvantage of using only water to fight electrical fires is that the water will not suppress the noxious and/or toxic gases produced by the burning electrical wires, insulation and other components. However, the admixture of super absorbent polymer and water of the present invention has physical and chemical properties which enable the admixture of super absorbent polymer and water to entrap and retain the noxious and/or toxic gasses and prevent the release of these gases into the atmosphere. This is an important advantage that the present invention has over the prior art because it prevents the noxious and/or toxic gases from reaching and affecting the firefighters.

Another advantage of the unique method of suppressing the spread of and extinguishing electrical fires of the present invention is that the admixture of super absorbent polymer and water retains the ash and other by-products produced by the electrical fire. By entrapping and retaining the ash and other particulates of the fire in a contained mass, the cleanup is facilitated, thus making the cleanup easier and quicker than the cleanup when only water is used to fight the electrical fires. The mass of the admixture of super absorbent polymer and water and fire particulates and residue can be readily cleaned up by vacuuming or other similar techniques. This also adds to the financial savings achieved by the unique method of the present invention.

When there are electrical fires in underground tunnels or conduits, the firefighters contact the electrical utility to have the electrical power turned off so they can fight the fire. In rare instances, the electrical power is not turned off which may result in serious injury and/or death of the firefighters when they apply water to the electrical fire. The present invention produces an admixture having properties such that the admixture will not readily flow or run from the area into which the admixture has been applied. Therefore, even though the super absorbent polymer water admixture contains a large amount of water, if the admixture is applied to a live electrical wire or component, the electricity will not travel back to the firefighter because the water will remain on the object to which the admixture has been applied due to its physical properties and not travel to the firefighter.

FIG. 1A illustrates a preferred embodiment of a method of suppressing the spread of and extinguishing fires of the present invention. In this embodiment there are utilities in an underground tunnel or conduit. These utilities can be electrical cables 12, telephone lines 14, water supply lines 16, etc. The tunnel also includes manholes 18, 20, and 22 which permit individuals to gain access to the tunnel or conduit. The manholes 18, 20, and 22 are closed by manhole covers 24, 26, and 28 respectively. As illustrated, there is a fire 11 involving the electrical cables 12 within the tunnel 10. A hose 50 is employed to deliver an admixture of super absorbent polymer and water 15 of the present invention to the tunnel or conduit 10. The entire tunnel or conduit 10 is then filled with the admixture of solid super absorbent polymer and water 15 from a hose 50 up to the manholes 18, 20, and 22. The hose 50 is connected to a supply of the admixture of solid super absorbent polymer and water, or alternatively to a separate supply of solid super absorbent polymer and a separate supply of water. The solid super absorbent polymer and water are mixed before they reach the end of hose 50. The admixture is then applied to the fire within the tunnel 10. The hose 50 is preferably passed through a manhole 22 above the tunnel 10 in FIG. 1A. The admixture of solid super absorbent polymer and water fills the tunnel 10, covering the electrical cables 12, the telephone lines 14 and the water supply lines 16. Any fire 11 on the electrical lines 14 or telephone lines 12 will be extinguished by the admixture of super absorbent polymer and water. The admixture of super absorbent polymer and water can be relative translucent, as illustrated in FIG. 1A or it can be opaque. Alternatively, the tunnel or conduit 10 can be filled with the admixture of super absorbent polymer and water up to the level at which the fire is extinguished. Additionally, the spread of any fire will be suppressed by the admixture also.

Figure 1B:
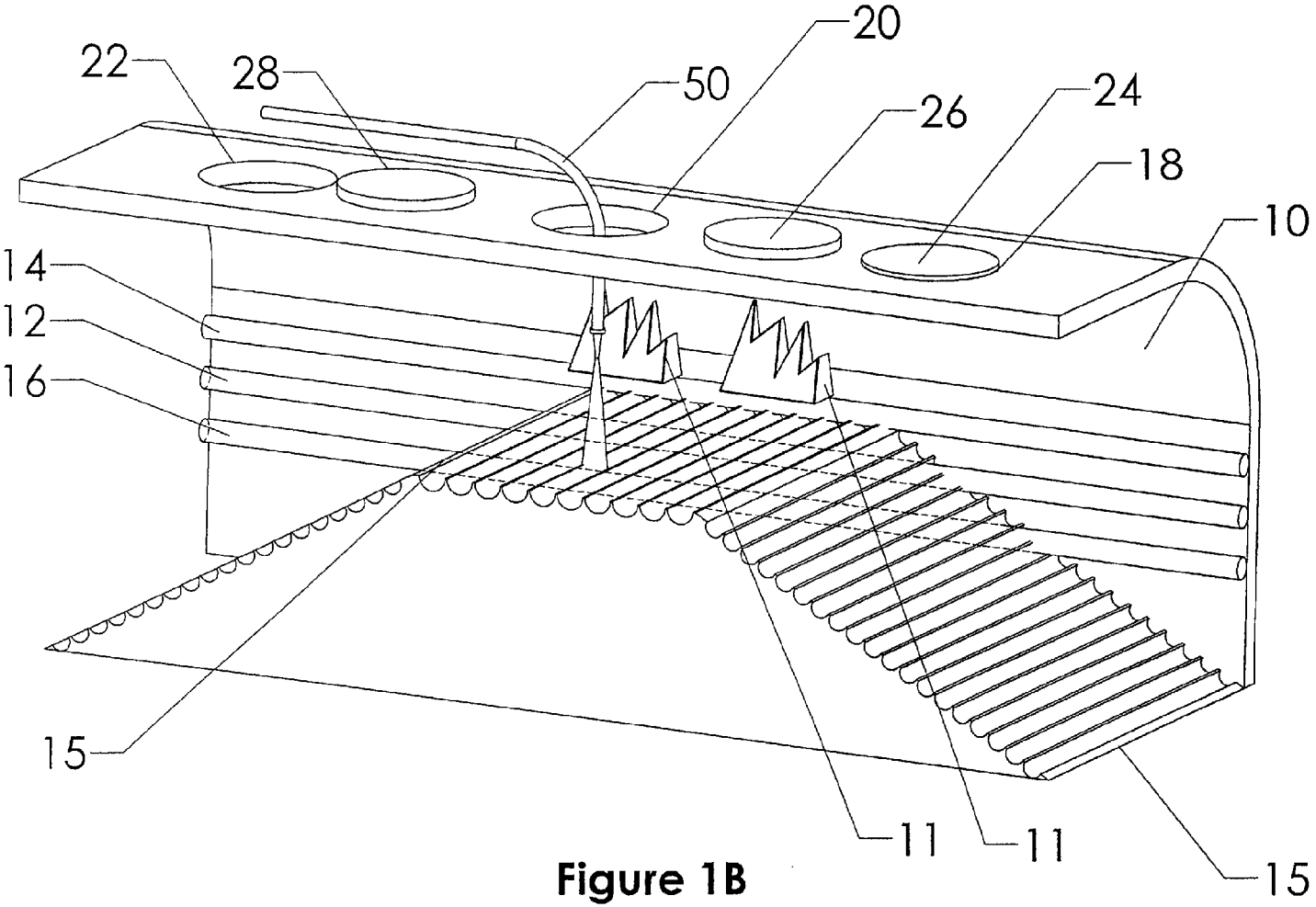
FIG. 1B is an illustration of a method of fighting an electrical fire in an underground tunnel or conduit employing an admixture of the present invention having a different viscosity.

FIG. 1B illustrates an alternative embodiment of a method of suppressing the spread of and extinguishing fires of the present invention. In this embodiment there also are utilities in an underground tunnel or conduit. These utilities can be electrical cables 12, telephone lines 14, water supply lines 16, etc. The tunnel also includes manholes 18, 20, and 22 which permit individuals to gain access to the tunnel or conduit. The manholes 18, 20, and 22 are closed by manhole covers 24, 26, and 28 respectively. As illustrated, there is also a fire 11 involving the electrical cables 12 within the tunnel 10. A hose 50 is employed to deliver the admixture of super absorbent polymer and water of the present invention to the tunnel or conduit 10. In the embodiment of the invention disclosed in FIG. 1B, the viscosity of the admixture of super absorbent polymer and water is greater than the viscosity of the admixture of super absorbent polymer and water disclosed in FIG. 1A. Therefore, the admixture of super absorbent polymer and water adheres to itself and forms a mound or pile as it enters the tunnel 10. This mound or pile of the admixture will not move or migrate past the area into which it was introduced. Therefore, the admixture can be delivered to a specific area within a tunnel or conduit and it will remain in that area and pile up until it reaches and extinguishes a fire without spreading along the tunnel or into adjacent tunnels. The hose 50 is connected to a supply of the admixture of solid super absorbent polymer and water, or alternatively to a separate supply of solid super absorbent polymer and a separate supply of water. The solid super absorbent polymer and water are mixed before they reach the end of hose 50. The admixture is then applied to the fire within the tunnel 10. The hose 50 is preferably passed through a manhole 22 above the tunnel 10. The admixture of solid super absorbent polymer and water piles up within the tunnel 10, covering the electrical cables 12, the telephone lines 14 and the water supply lines 16. Any fire 11 on the electrical lines 14 or telephone lines 12 will be extinguished by the admixture of super absorbent polymer and water. Alternatively, the tunnel or conduit 10 can be completely filled with the admixture of super absorbent polymer and water up to the level at which the fire is extinguished. Additionally, the spread of any fire will be suppressed by the admixture also. The admixture of super absorbent polymer and water can be relative translucent, as illustrated in FIG. 1B or it can be opaque.

Figure 2:
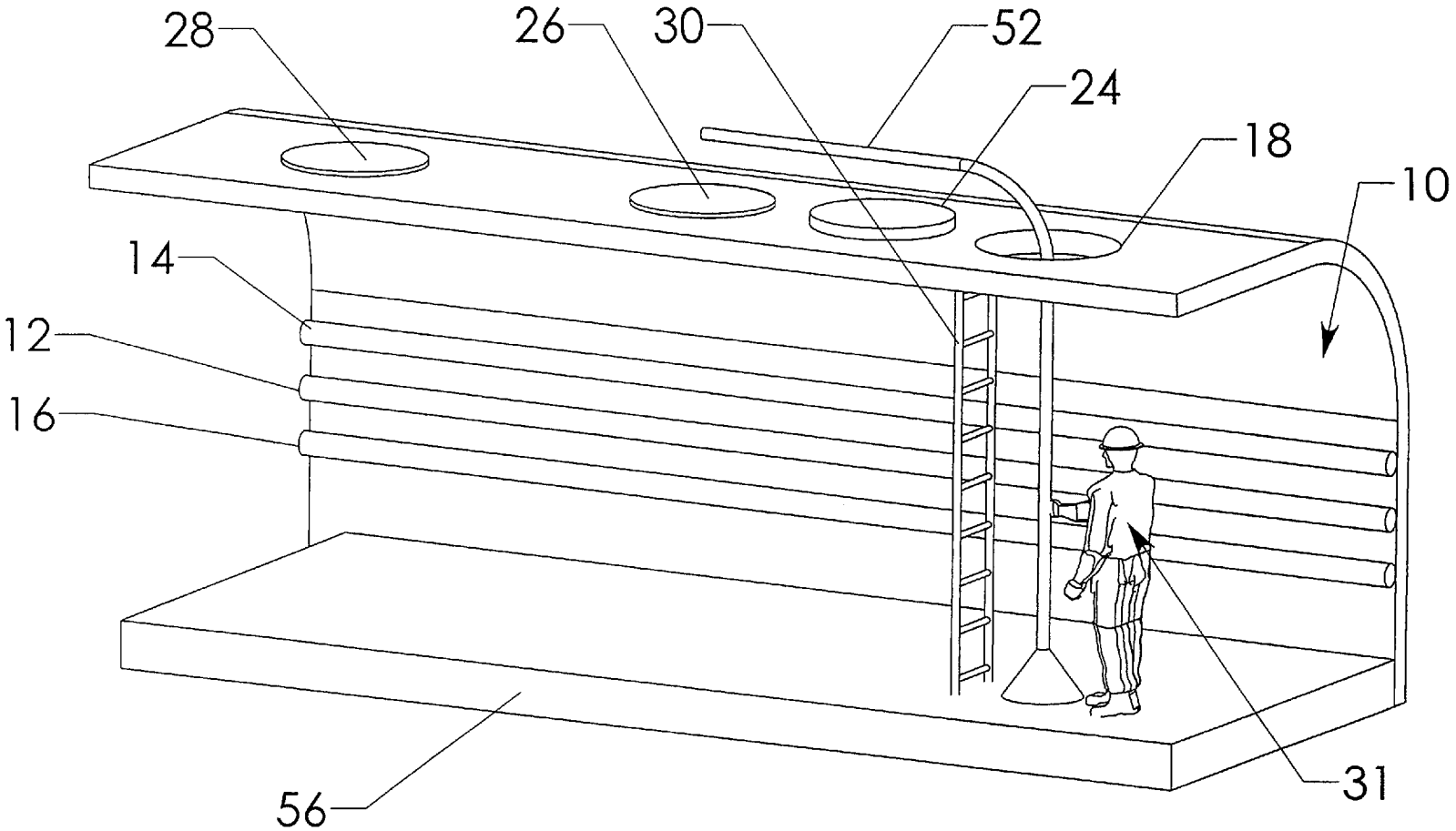
FIG. 2 is an illustration of a clean-up operation after an electrical fire has been extinguished by the method and admixture of the present invention.
Figure 7:
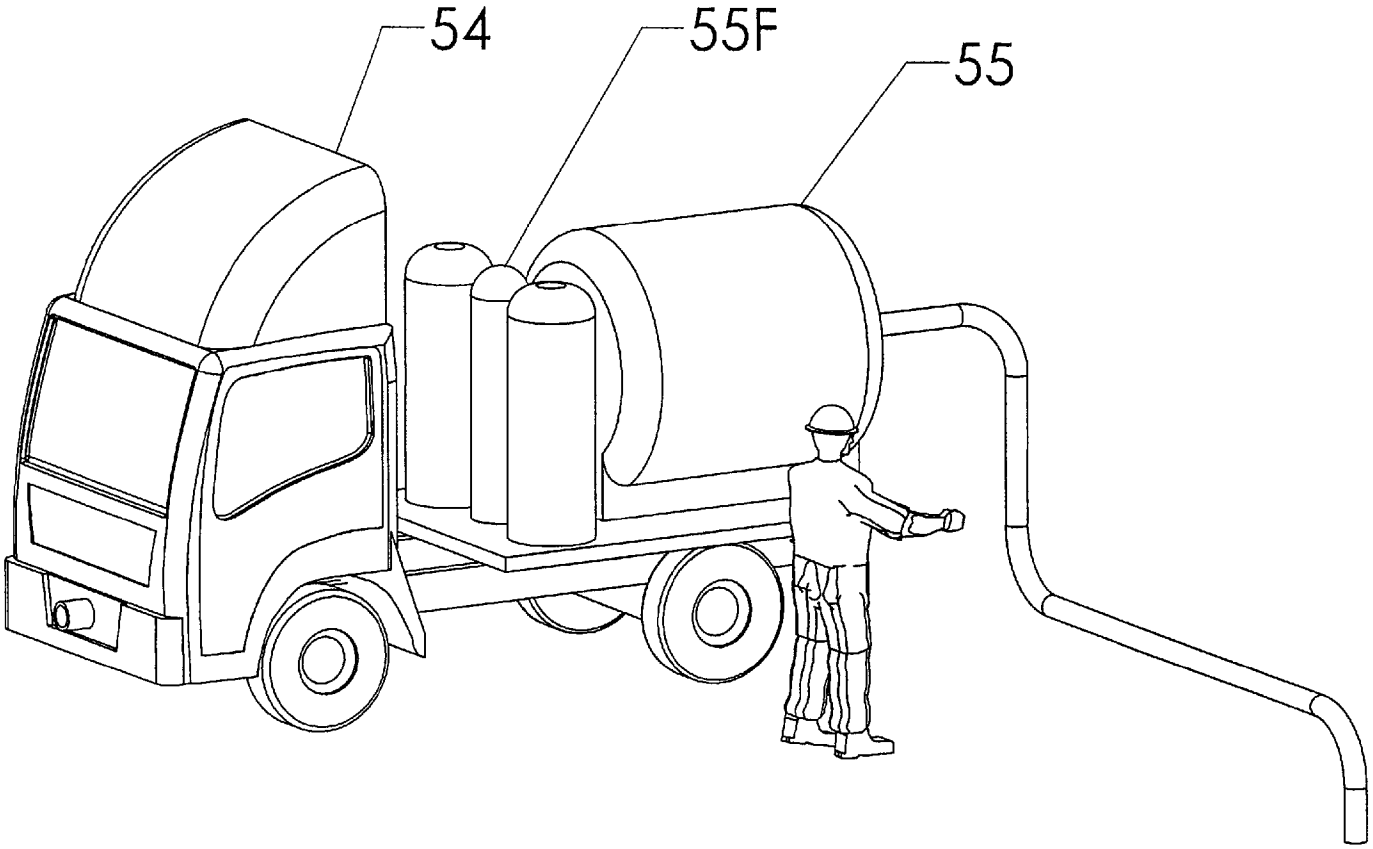
FIG. 7 is a side view of a truck used to vacuum up and contain the residue and by-products after a fire has been extinguished by the method of present invention.

FIG. 2 illustrates a clean-up process after a fire has been extinguished. A hose 52 is connected to a source of vacuum and manipulated by an individual 31. The source of vacuum is preferably on a truck 54 or similar vehicle (FIG. 7). The source of vacuum could also be in a permanent location or a portable location, rather than on a truck. The hose 52 withdraws or sucks up the particulates 56 and other residue from the fire. This leaves the area in which the fire occurred relatively clean. Since the admixture of solid super absorbent polymer and water entraps the particulates and noxious and/or toxic gasses, the clean up is substantially easier and quicker than the clean up from other methods of fire suppression and extinguishing. A test report of a plurality of tests performed by Kinectrics of the by-products and particulates remaining after the method of suppressing the spread of and extinguishing electrical fires of the present invention were employed follows (FireIc® is the trademark of the admixture of solid super absorbent polymer and water used in the method the present invention):

ARC Performance & Byproducts of Fireice®

Summary of Air Sampling Results

1. Test Description

A total of five field test air sampling collections were undertaken on Jan. 18, 2011, at the High Current Laboratory (HCL) to evaluate the air emissions released from the application of FireIce® to artificially faults generated using copper and aluminum cables provided by GelTech Solutions. The five test scenarios were air sampled for airborne metals and organics. The description of the tests is given in Table 1.

In all the tests the cables were installed at the bottom of the concrete box, and the fault between the cables was created using a fuse wire. The approximate dimensions of the interior volume of the concrete box are: 33"×33"×24". The concrete box drawing is given in Appendix A (not attached). One calorimeter was installed above the concrete box to measure the incident energy generated by the fault. Pictures of the set-up are given in Appendix A (not attached).

Each test was recorded using a high speed video camera and a normal speed video camera. The current and the voltage waveforms are given in Appendix B (not attached). All the test data recorded (recorded waveforms, videos and photos) are provided in digital format on the DVD (not attached).

The sampling equipment consisted of five separate sampling trains, each with a sampling pump drawing air through various air sampling components using a calibrated mass flow controller to maintain constant flow. The sampling time for each train was two minutes during each of the 5 arc test scenarios. For each sampling train a flow rate was selected based on the type of air sample being collected. The five sampling trains consisted of the following components and the air flow rate utilized:

1. A sampling train consisting of a MCE (mixed cellulose ester) filter in a cartridge filter holder for aerosol collection generated during the arc. The air flow rate through the filter was set to 1 L/min.

2. A sampling train for organic compounds using two Carbotrap™ 300 sampling tubes in series (front-back arrangement) was placed with the front sampling tube inlet at the edge of the concrete bunker. The air flow rate for the organics sampling tube train was 0.050 L/min.

3. A sampling train consisting of three impingers in series with 1M nitric acid in the first two impingers and an empty third impinger was used to trap airborne metals. The metals train air flow rate was set to 0.50 L/min.

4. A sampling train identical to the one described in 3 but with 0.5M KOH added to the first two impingers and an

TABLE 1

Test description

| Test # | Shot# | Test description | Cable description |
|---|---|---|---|
| 1 | 119 | New cables with copper conductor artificially faulted to create arc with no FireIce ® added. Target fault current: 2 kA. Fault duration: until fault self-extinguished. | coned 500 kcmil Cu 600 V EAM/LSNH installed in coned precast concrete distribution box type B-3.6 |
| 2 | 120 | New cables with copper conductor artificially faulted to create arc with FireIce ® added at the on-set of arc. Target fault current: 2 kA. Fault duration: until fault self-extinguished. | coned 500 kcmil Cu 600 V EAM/LSNH installed in coned precast concrete distribution box type B-3.6 |
| 3 | 121 | New cables with copper conductor artificially faulted to create arc with FireIce ® added at the on-set of arc - this was a repeat of test #2 due to poor arc generation and non-propagation of arc. Target fault current: 2 kA. Fault duration: until fault self-extinguished. | coned 500 kcmil Cu 600 V EAM/LSNH installed in coned precast concrete distribution box type B-3.6 |
| 4 | 122 | New cables with aluminum conductor artificially faulted to create arc with FireIce ® added at the on-set of arc. | coned 350 MCM Al 600 V EPR installed in coned precast concrete distribution box type B-3.6 |
| 5 | 123 | New cables with aluminum conductor artificially faulted to create arc with "FireIce ®" added to concrete box to cover faulted cables prior to high current being applied to create arc. Target fault current: 2 kA. Fault duration: until fault self-extinguished. | coned 350 MCM Al 600 V EPR installed in coned precast concrete distribution box type B-3.6 |

empty third impinger was setup plus an additional Carbotrap™ 300 organic compound sampling train as described in 2 was added in series to the outlet of the last impinger. The air sampling flow rate was set to 0.251/min for this train.

5. A final sampling train consisting of 3 impingers in series as described in 3 but with KOH added to the first two impingers and an empty third impinger to capture acidic species possibly generated during the FireIce® tests. The air sampling flow rate was set to 0.25 L/min for this train.

2. Organic Compound Sampling Results—Carbotrap™ 300 Tube Analyses 2.1 Post-Impinger Air Samples The organic compounds released to air were captured using Carbotrap™ 300 tubes after the air sample passed through a KOH impinger train. The sampling flow rate was 0.25 L/min. The total mass of organic compounds collected during each of the five arc fault tests are given in Table 2. The organic compounds identified in the air samples are summarized in Table 3.

TABLE 2

Total Mass of Organic Compounds Collected on Carbotrap ™ 300 Sample Tubes and Estimated FireIce ® Inhibition Ratio for Organic Compound Release

| Test Number & Description | Total Mass of Organics Collected on Carbotrap ™ 300 Tubes (ng) | Minimum Removal Efficiency Compared to Test 1 |
|---|---|---|
| 1 Pair of New Neoprene Copper Cables - No FireIce ® Applied | 615 | — |
| 2 Pair of New Neoprene Jacketed Copper Cables - FireIce ®-Added at On-Set of Arc | 189 | 3.2 |
| 3 Pair of New Neoprene Jacketed Copper Cables - FireIce ®-Added at On-Set of Arc (Repeat) | 138 | 4.5 |
| 4 Pair of New Neoprene Jacketed Aluminum Cables - FireIce ® Added at On-Set of Arc | No Organic Compounds Detected | >61.5* |
| 5 Pair of New Neoprene Jacketed Aluminum Cables - FireIce ® Added Prior to Arc Generation | No Organic Compounds Detected | >61.5* |

Note:

*Assumed minimum removal efficiency is assumed to be >61.5 as detection limit for any single organic compound is 10 ng.

TABLE 3

Organic Compounds Identified in High Flow Samples

| Test Number & Description | Organic Compounds Collected on Carbotrap ™ 300 Tubes Passage Through KOH Impingers | Total Organic Compound Mass (Front + Back) (ng) |
|---|---|---|
| 1 Pair of New Neoprene Copper Cables - No FireIce ® Added | ethane-l-chloro-1,1 difluoro* | 48000* |
| | 2-butene, 2-methyl | 18 |
| | 1,3-butadiene, 2-methyl | 40 |
| | 1,3 pentadiene | 35 |
| | 1,4 pentadiene | 14 |
| | cyclopentane | 23 |
| | 1-pentene, 2-methyl | 36 |
| | benzene | 62 |
| | 1,4-cyclohexadiene | 25 |
| | 3-hexen-l-ol | 28 |
| | toluene | 237 |
| | ethylbenzene | 48 |
| | styrene** | 2740** |
| | a-methyl styrene** | 53** |
| 2 Pair of New Neoprene Jacketed Copper Cables - FireIce ®-Added at On-Set of Arc | ethane-l-chloro-1,1-difluoro | 68* |
| | 1,3-butadiene | 14 |
| | 1-pentene, 2-methyl | 21 |
| | propane, 2-methyl-1-nitro | 31 |
| | 3-heptene | 8 |
| | benzene | 62 |
| | butane, I-chloro-2-methyl | 25 |
| | styrene** | 99** |
| | unknown | 28 |
| 3 Pair of New Neoprene Jacketed Copper Cables - FireIce ®-Added at On-Set of Arc (Repeat) | ethane-l-chloro-1,l-difluoro | 264* |
| | 1-propene, 2-methyl | 16 |
| | 1,3-butadiene | 40 |
| | 2-butene, 2-methyl | 12 |
| | 1-pentene, 2-methyl | 25 |
| | benzene | 34 |
| | unknown | 11 |

TABLE 3-continued

| Organic Compounds Identified in High Flow Samples | | |
|---|---|---|
| Test Number & Description | Organic Compounds Collected on Carbotrap ™ 300 Tubes Passage Through KOH Impingers | Total Organic Compound Mass (Front + Back) (ng) |
| 4 Pair of New Neoprene Jacketed Aluminum Cables - FireIce ® Added at On-Set of Arc | No organic compounds detected on both front and back Carbotrap ™ 300 tubes | 0 |
| 5 Pair of New Neoprene Jacketed Aluminum Cables - FireIce ® Added Prior to Arc Generation | No organic compounds identified on both front and back Carbotrap ™ 300 tubes | 0 |

Notes:

*The ethane-1-chloro-1,1-difluoro is suspected to be contamination resulting from the partial decomposition of impinger train holder used during testing. The Freon HCFC 142b released during tests 1 to 3 is the trapped blowing agent used to make the closed cell foam. The foam was used to support and secure the impinger trains. Not included in organic compound mass reported.

**The styrene and a-methyl styrene are unintentional contaminants generated from the destruction of the aerosol filter holder used during the first arc fault Test-1. The filter- holder was too close to the arc-fault zone and did not survive Test-1. The styrene values are not included in organic compound mass reported.

2.2 Direct Air Sampling

The total mass of organic compounds in the air samples collected directly on to Carbotrap™ 300 tubes during each of the five arc fault tests are given in Table 4. The organic compounds captured with the Carbotrap™ 300, tubes and subsequently detected during analysis are listed in Table 5. The sampling flow rate was 0.05 L/min.

TABLE 4

| Total Mass of Organic Compounds on Direct Air Sample onto Carbotrap ™ 300 Tubes and FireIce ® Inhibition Ratio | | |
|---|---|---|
| Test Number & Description | Total Mass of Organics Collected on. Carbotrap ™ 300 Tubes (Front + Back) (ng) | Minimum Removal Efficiency Compared to Test 1 |
| 1 Pair of New Neoprene Jacketed Copper Cables - No FireIce ® | 158 | — |
| 2 Pair of New Neoprene Jacketed Copper Cables - FireIce ®-Added at On-Set of Arc | 65 | 2.4 |
| 3 Pair of New Neoprene Jacketed Copper Cables - FireIce ®-Added at On-Set of Arc (Repeat) | 15 | >10 |
| 4 Pair of New Neoprene Jacketed Aluminum Cables - FireIce ® Added at On-Set of Arc | None Detected | >15.8 |

TABLE 4-continued

| Total Mass of Organic Compounds on Direct Air Sample onto Carbotrap ™ 300 Tubes and FireIce ® Inhibition Ratio | | |
|---|---|---|
| Test Number & Description | Total Mass of Organics Collected on. Carbotrap ™ 300 Tubes (Front + Back) (ng) | Minimum Removal Efficiency Compared to Test 1 |
| 5 Pair of New Neoprene Jacketed Aluminum Cables - FireIce ® Added Prior to Arc Generation | 10 | 15.8 |

The total organic compound concentration measured directly with the Carbotrap™ 300 tubes associated with the copper cable arc fault in Test-1 is estimated to be 1.6 mg/m3 without the application of FireIce®. For Test-2 through Test-5 the organic compound concentrations are estimated to be 0.6 mg/m3, 0.15 mg/m3, 0.0 mg/m3 and 0.1 mg/m3, respectively.

The FireIce® application appears to be effective in reducing organic emissions for both the copper cables and the aluminum cables. The removal efficiencies estimated in Table 2 and Table 4 compare well. The application of FireIce0 reduces organic emissions when applied with the arc fault is active. The presence of external contamination confirms the effective organic sampling in the vicinity of the arc fault during the five tests.

TABLE 5

| Organic Compounds Identified in Direct Air Samples Collected on Carbotrap ™ 300 Tubes | | |
|---|---|---|
| Test Number &Description | Organic Compounds Collected on Carbotrap ™ 300 Tubes | Organic Compound Mass (ng/tube) |
| 1 Pair of New Neoprene Copper Cables - No FireIce ® Added | Ethane-l-chloro-1,1 difluoro* | 53* |
| | 1-pentene, 2-methyl | 15 |
| | benzene | 64 |
| | toluene** | 41 |
| | styrene | 70 |
| | methyl styrene** | 217* |
| | isobutyl nitrile | 11 |
| | propane, 2-methyl-1-nitro | 14 |
| | unknown | 13 |

TABLE 5-continued

| Organic Compounds Identified in Direct Air Samples Collected on Carbotrap ™ 300 Tubes | | | |
|---|---|---|---|
| | Test Number &Description | Organic Compounds Collected on Carbotrap ™ 300 Tubes | Organic Compound Mass (ng/tube) |
| 2 | Pair of New Neoprene Jacketed Copper Cables - FireIce ®- Added at On-Set of Arc | 1-propene, 2-methyl | 8 |
| | | 1,3 butadiene | 16 |
| | | 2-butene, 2-methyl | 8 |
| | | 1-pentene, 2-methyl | 23 |
| | | unknown | 10 |
| 3 | Pair of New Neoprene Jacketed Copper Cables - FireIce ®- Added at On-Set of Arc (Repeat) | 1-pentene, 2-methyl | 15 |
| 4 | Pair of New Neoprene Jacketed Aluminum Cables - FireIce ® Added at On-Set of Arc | No organic compounds detected on both front and back Carbotrap ™ 300 tubes | 0 |
| 5 | Pair of New Neoprene Jacketed Aluminum Cables - FireIce ® Added Prior to Arc Generation | No organic compounds identified on both front and back Carbotrap ™ 300 tubes | 0 |
| | | Unknown peak (Front tube only) | 10 |

Notes:

*The ethane-l-chloro-1,1-difluoro is suspected to be contamination resulting from the partial decomposition of impinger train holder used during testing. The Freon HCFC 142b released during testing is the trapped blowing agent used to make the closed cell foam. The foam was used to support and secure the impinger trains. The Freon was not included in organic compound mass reported.

**The styrene and a-methyl styrene are unintentional contaminants generated from the destruction of the aerosol filter holder used during the first arc fault Test-1. The filter- holder was too close to the arc-fault zone and did not survive Test-1. The styrene values are not included in organic compound mass reported.

TABLE 6

| Metals Analysis Results (PPM) Filter Pack Sampling ~2 m Above Arc Fault | | | | | |
|---|---|---|---|---|---|
| Metal | Blank (Avg) | Test 2 (Cu) | Test 3 (Cu) | Test 4 (Al) | Test 5 (Al) |
| Al | <0.5 | 3.15 | 6.81 | 1.48 | <0.5 |
| Ca | 2.15 | 1.80 | 4.96 | 2.52 | 1.93 |
| Cu | <1.5 | 94.8 | 312 | 1.98 | <1.5 |
| Fe | <0.25 | <0.25 | 2.85 | <0.25 | <0.25 |
| K | 67 | 68 | 39 | 28 | 23 |
| Mg | 0.19 | 8.4 | 18.9 | 0.25 | <0.1 |
| Na | <2.5 | <2.5 | 5.8 | <2.5 | <2.5 |
| P | <1 | <1 | 1.2 | <1 | <1 |
| S | <1 | <1 | 3.7 | <1 | <1 |
| Si | <1 | 4.3 | 20.5 | <1 | <1 |
| Ag | <0.005 | <0.005 | 0.007 | <0.005 | <0.005 |
| As | <0.05 | <0.05 | <0.05 | <0.05 | <0.05 |
| B | <0.05 | <0.05 | <0.05 | <0.05 | <0.05 |
| Ba | 0.007 | 0.012 | 0.022 | 0.008 | 0.006 |
| Bi | <0.005 | <0.005 | <0.005 | <0.005 | <0.005 |
| Be | <0.005 | <0.005 | <0.005 | <0.005 | <0.005 |
| Cd | <0.005 | <0.005 | <0.005 | <0.005 | <0.005 |
| Co | <0.005 | <0.005 | <0.005 | <0.005 | <0.005 |
| Cr | <0.005 | <0.005 | <0.005 | <0.005 | <0.005 |
| Cs | <0.005 | <0.005 | <0.005 | <0.005 | <0.005 |
| Li | <0.005 | <0.005 | 0.013 | <0.005 | <0.005 |
| Mn | 0.005 | 0.006 | 0.053 | 0.007 | 0.006 |
| Mo | <0.005 | <0.005 | <0.005 | <0.005 | <0.005 |
| Ni | 0.010 | 0.013 | 0.024 | 0.016 | 0.011 |
| Pb | <0.005 | 1.93 | 4.79 | 0.063 | 0.015 |
| Sb | 0.003 | 2.17 | 5.19 | 0.072 | 0.017 |
| Se | <0.05 | <0.05 | <0.05 | <0.05 | <0.05 |
| Sn | 0.029 | 0.036 | 0.028 | 0.006 | 0.005 |
| Sr | 0.007 | 0.006 | 0.028 | 0.009 | 0.006 |
| Th | <0.005 | <0.005 | <0.005 | <0.005 | <0.005 |
| Ti | 0.151 | 0.122 | 0.309 | 0.007 | 0.007 |
| Th | <0.005 | <0.005 | <0.005 | <0.005 | <0.005 |
| W | <0.005 | <0.005 | <0:005 | <0.005 | <0.005 |
| Zr | <0.005 | <0.005 | <0.005 | <0.005 | <0.005 |
| V | <0.05 | <0.05 | <0.05 | <0.05 | <0.05 |
| Zn | 0.037 | 1.22 | 3.02 | 0.054 | 0.042 |
| Hg | <0.005 | <0.005 | <0.005 | <0.005 | <0.005 |
| U | <0.005 | <0.005 | <0.005 | <0.005 | <0.005 |

TABLE 7

| Metals Analysis Results (PPM) from Acid Impinger Sampler Train | | | | | | |
|---|---|---|---|---|---|---|
| Metal | MDL | Test 1 (Cu) | Test 2 (Cu) | Test 3 (Cu) | Test 4 (Al) | Test 5 (Al) |
| Al | <0.01 | 0.145 | 0.272 | 0.330 | 0.328 | 0.640 |
| Ca | <0.01 | 0.485 | 1.30 | 0.388 | 0.523 | 0.094 |
| Cu | <0.01 | 0.22 | 0.918 | 0.816 | 0.66 | 0.062 |
| Fe | <0.005 | 0.02 | 0.056 | 0.023 | 0.028 | 0.025 |
| K | <0.01 | 1.24 | 0.896 | 0.644 | 77.8 | 13000 |
| Mg | <0.002 | 0.042 | 0.134 | 0.056 | 0.318 | 0.012 |
| Na | <0.05 | 0.951 | 0.727 | 1.78 | 0.905 | 10.5 |
| P | <0.02 | <0.02 | 0.049 | <0.02 | <0.02 | <0.02 |
| S | <0.05 | 0.043 | 0.070 | 0.099 | 0.043 | 0.504 |
| Si | <0.1 | 0.303 | 0.48 | 1.10 | 0.49 | 21.4 |
| Ag | <0.0001 | 0.004 | 0.005 | 0.004 | 0.005 | 0.002 |
| As | <0.001 | <0.001 | <0.001 | 0.001 | <0.001 | <0.001 |
| B | <0.025 | 0.853 | 0.638 | 1.61 | 0.922 | 2.88 |
| Ba | <0.0001 | 0.006 | 0.008 | 0.007 | 0.006 | 0.002 |
| Bi | <0.001 | <0.001 | <0.001 | <0.001 | <0.001 | <0.001 |
| Be | <0.001 | <0.001 | <0.001 | <0.001 | <0.001 | <0.001 |
| Cd | <0.0001 | <0.0001 | <0.0001 | <0.0001 | 0.0002 | <0.0001 |
| Co | <0.0001 | 0.0001 | 0.0004 | <0.0001 | 0.0002 | 0.0001 |
| Cr | <0.0001 | 0.0007 | 0.0009 | 0.0006 | 0.0006 | 0.019 |
| Cs | <0.0001 | <0.0001 | <0.0001 | <0.0001 | 0.002 | 0.819 |
| Li | <0.001 | <0.001 | <0.001 | <0.001 | <0.001 | 0.004 |
| Mn | <0.0001 | 0.001 | 0.002 | 0.0006 | 0.0010 | 0.015 |
| Mo | <0.0001 | 0.0002 | 0.0002 | 0.0003 | 0.0002 | 0.0020 |
| Ni | <0.0001 | 0.002 | 0.001 | 0.002 | 0.002 | 0.001 |
| Pb | <0.0001 | 0.003 | 0.003 | 0.008 | 0.009 | 0.008 |
| Sb | <0.001 | 0.002 | 0.002 | 0.007 | 0.003 | <0.001 |
| Se | <0.001 | <0.001 | <0.001 | <0.001 | <0.001 | 0.004 |
| Sn | <0.0001 | 0.0004 | 0.0003 | 0.0002 | 0.0005 | 0.0020 |
| Sr | <0.0001 | 0.002 | 0.005 | 0.002 | 0.003 | 0.001 |
| Th | <0.0001 | <0.0001 | <0.0001 | <0.0001 | <0.0001 | <0.0001 |
| Ti | <0.0001 | 0.001 | 0.004 | 0.002 | 0.002 | 0.014 |
| Tl | <0.0001 | <0.0001 | <0.0001 | <0.0001 | <0.0001 | <0.0001 |
| W | <0.0001 | <0.0001 | <0.0001 | <0.0001 | 0.0001 | 0.037 |
| Zr | <0.0001 | 0.0002 | 0.0008 | 0.0007 | 0.0007 | 0.027 |
| V | <0.0001 | <0.0001 | <0.0001 | <0.0001 | <0.0001 | 0.0002 |
| Zn | <0.0001 | 0.01 | 0.009 | 0.01 | 0.021 | 0.003 |
| Hg | <0.0001 | <0.0001 | <0.0001 | <0.0001 | <0.0001 | <0.0001 |
| U | <0.0001 | <0.0001 | <0.0001 | <0.0001 | <0.0001 | <0.0001 |

A 2-liter air sample was taken through a filter pack at about 2 meters above each arc test. Each available exposed filter was analyzed for metals and other elements. The results for 38 element analyses are presented in Table 6. As a note, the filter pack used during Test-1 was destroyed by the extreme heat generated by the copper cable arc as the filter was too close to the arc.

Some key observations are noted from filter analysis for the Test-2 through Test-5 data available in Table 6:

A key result noted is the below detection of aluminum for Test 5 compared to a measurable detection in Test 4. Both tests used new aluminum cables for the arc fault but in the Test 5 case the fault zone was encapsulated in FireIce® prior to arc fault generation whereas for Test 4 the arc fault was initiated into air and then FireIce® was added to quench the arc fault. The lead (Pb), antimony (Sb), magnesium (Mg), copper (Cu) and calcium (Ca) results add confirmation to the reduction of released metals with the arc fault encapsulated.

The counter ion for FireIce® is potassium (K). For all four arc fault tests, the filter analysis did not detect potassium above the nominal background concentration of potassium present on the filter prior to exposure. This is good evidence that FireIce® did not undergo detectable degradation during the arc faults where FireIce® was applied.

Test 2 and Test 3 were essentially duplicate tests using new neoprene jacketed copper cables for the arc fault with Test 3 having the more sustained arc fault. The procedure for applying FireIce® was the same for both tests. At the on-set of the arc fault the addition of FireIce® was begun and continued until the concrete cell was about Vs full. For the more sustained arc fault (Test 3) the key metals from the vaporized copper cable as measured with the filter pack were about 3 to 4 times higher than the metals released in the much shorter arc period of Test 2. Key metals released were aluminum (1.7%), copper (80%), magnesium (4.8%), zinc (0.8%), lead (1.2%), calcium (1.3%) and antimony (1.3%) with remaining components at <1% to only present at trace levels.

The estimated airborne total metals concentration for Test 3 is 0.17g/m$^3$ and for Test 2 is 0.058 g/m$^3$. Similarly for the aluminum cables the estimated airborne total metals concentration for Test 4 is 0.003 g/m$^3$ and for Test 5 is 0.001 g/m$^3$.

For comparison the Ontario Ministry of Labor time-weighted average exposure concentration (TWAEC) for a variety of fumes and particulate, ranges from 0.003 to 0.01 g/m$^3$ for 40-hr work week and for short term exposures, the particulate concentrations range from 0.005 to 0.02 g/m$^3$ for a maximum 15 minute continuous exposure depending on the fume and particulate present.

Observations from the metals train analysis for Tests 1 through 5 are summarized below and are based on the metal/element analysis data present in Table 7.

The high level of potassium in the Test 5 results were from the entrainment of airborne FireIce® into the first impinger as the arc generated gas that ejected some of the FireIce® material into the air. This is confirmed by the increase in silica, sodium and sulfur.

For Test 4 a significant level of copper (0.66 ppm) is measured as copper residue from Tests 1 to 3 is released during the aluminum cable arc fault. However in Test 5 very little copper is detected (>10× less detected 0.062 ppm) with the FireIce® encapsulating the arc fault zone. This also confirmed by the similar reduction in magnesium detected.

The impinger samples collected similar amounts of metals for the copper cable arc fault tests. The metal concentration levels were and are given in Table 7.

3. Summary

The application of FireIce® to neoprene jacketed copper and aluminum cables is effective in reducing airborne organic compounds and also airborne metals. Removal efficiencies from 2 times to greater than 15 times can be expected when added to an active arc fault. For a FireIce® encapsulated arc fault greater than 60 times removal of metals and arc generated arc products is possible based on the five tests performed.

Figure 3:
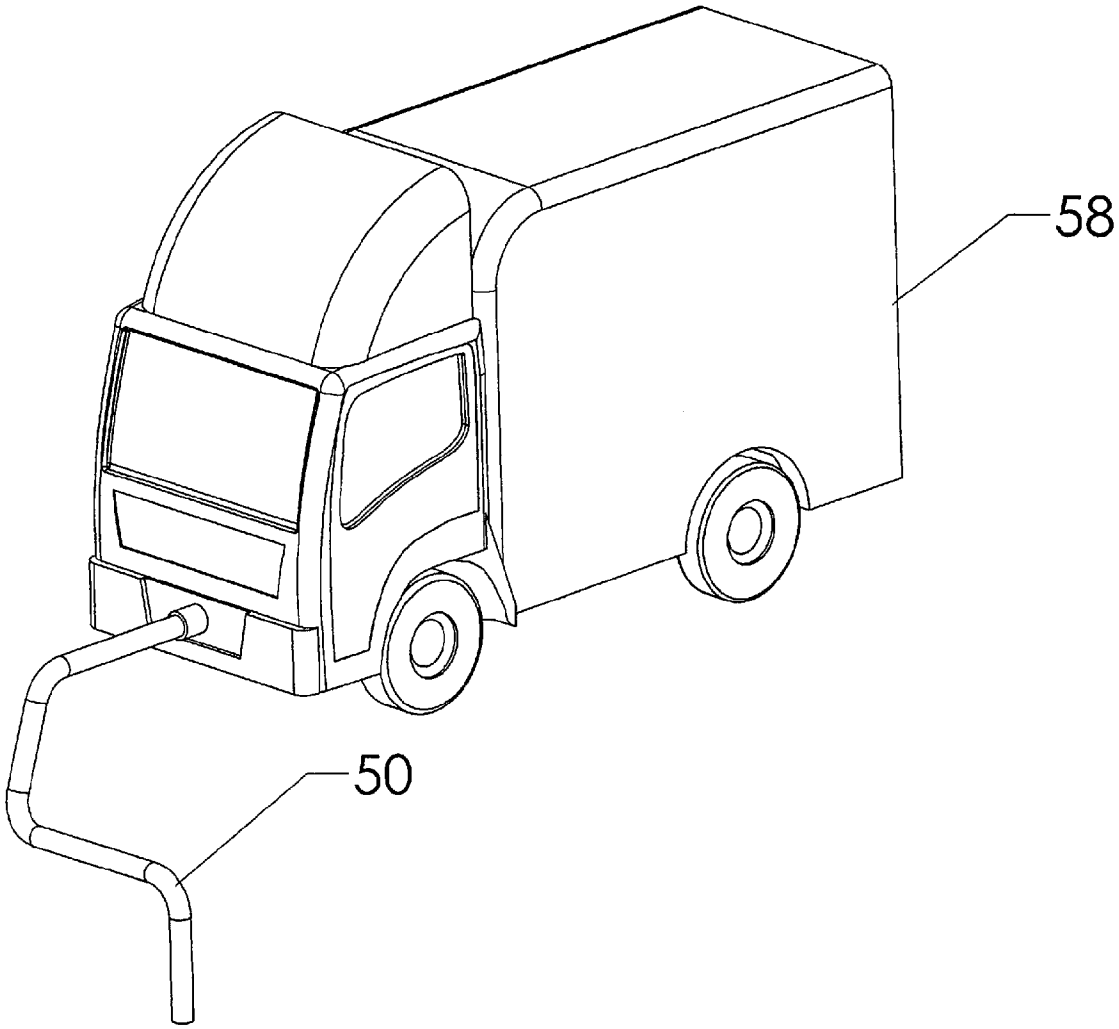
FIG. 3 is a truck/van normally used by a utility company.
Figure 6:
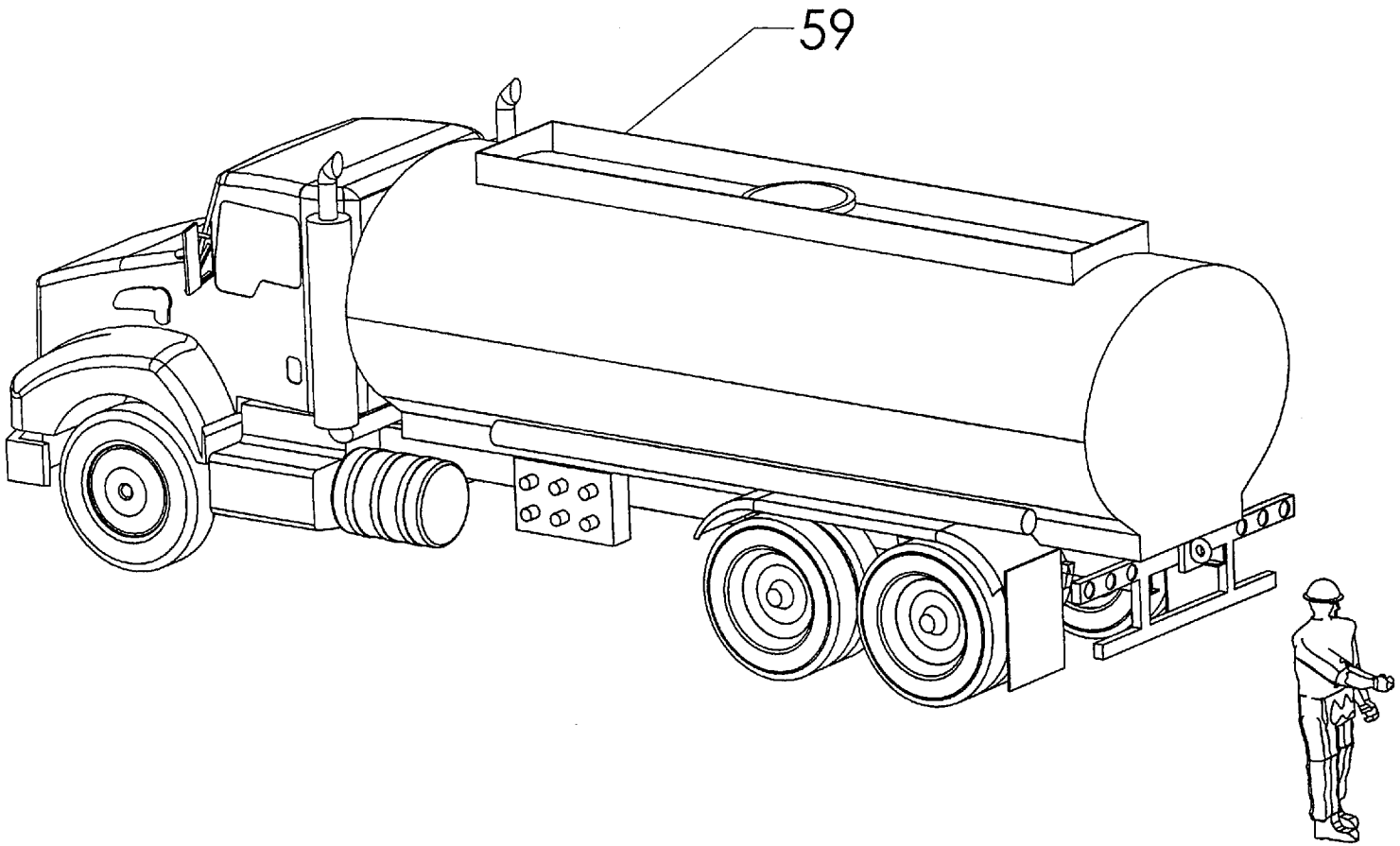
FIG. 6 is a perspective view of a truck used to transport the material to perform the method of the present invention.

In another embodiment of the present invention, a truck or van is illustrated in FIG. 3. The admixture of super absorbent polymer and water supplied to hose 50 can come from a vehicle such as a utility van 58 (FIG. 3), commonly employed by electric utility companies to perform services on the electrical utilities. A hose 50 secured to the van 58 is employed to deliver the admixture of super absorbent polymer and water to the site of a fire. The preferred location of the connection of hose 50 to the van 58 is at the front bumper, as illustrated. However, the hose 50 can be secured to van 58 at any location on the van. FIG. 6 illustrates a water tanker type of truck 59 which can be employed in place of van 58 in the present invention. The hose 50 can be secured to the tanker truck 59 at any location where there is a fluid outlet. Use of the van 58 or truck 59 limits the amount of admixture that is applied according to the amount that is stored on the vehicle. This is a batch process and is limited in quantity as depicted by the van 58 and truck 59.

Figure 4:
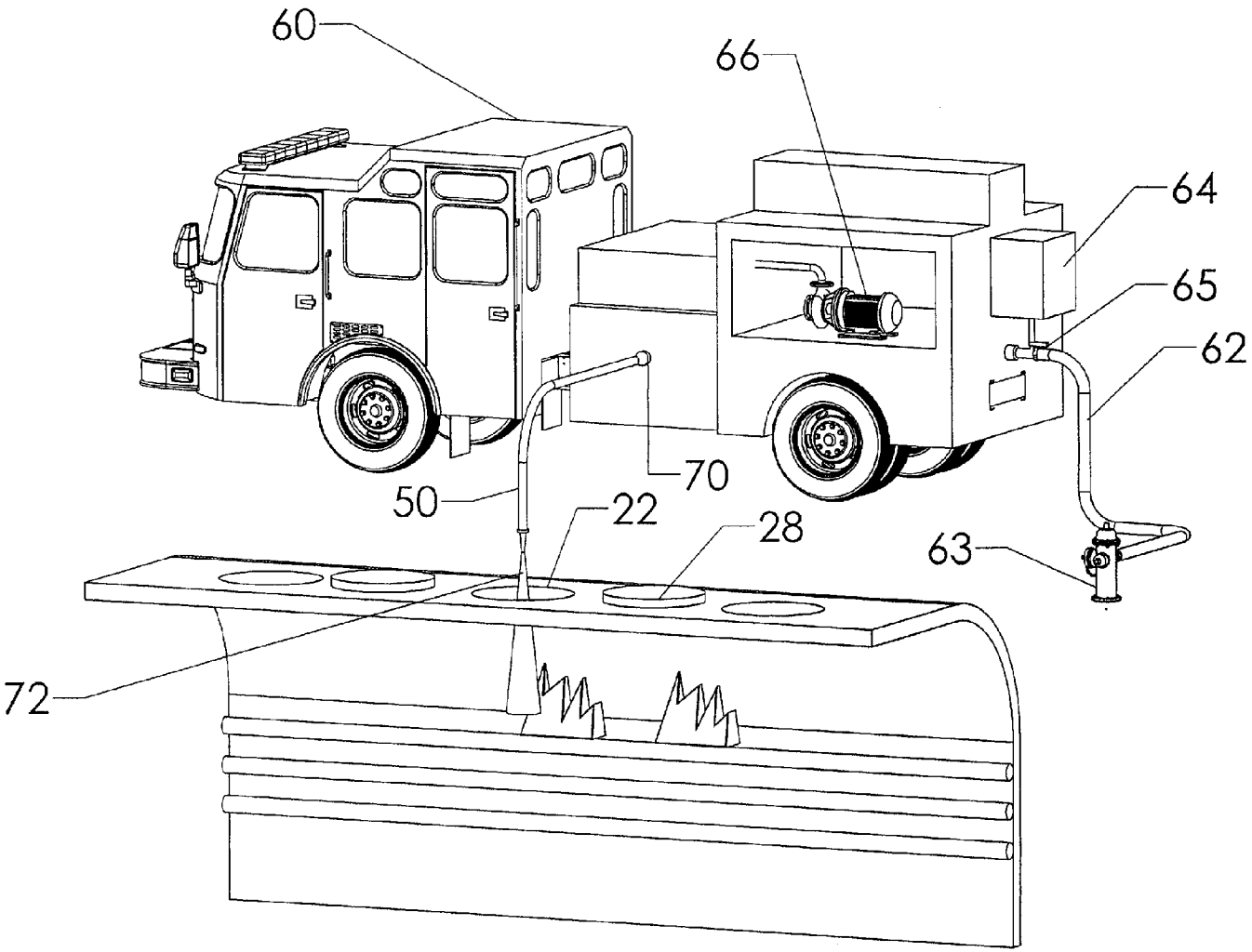
FIG. 4 is a fire truck connected to a fire hydrant and employing an onboard supply of super absorbent polymer and an eductor.

In the embodiment of the present invention illustrated in FIG. 4, the hose 50 can be connected to a supply of the admixture of super absorbent polymer and water provided by a fire truck 60. A hose 62 is secured to a fire hydrant 63. The fire hydrant 63 is fluidly connected to a supply of water. A container 64, secured to the fire truck, holds a supply of solid super absorbent polymer. A valve 65 regulates the amount of super absorbent polymer that is mixed with the water from the fire hydrant 63 to obtain an admixture of the components in the proportions indicated herein above as a continuous process. The unlimited supply of water from the hydrant allows the admixture to be made as a continuous process. A pump 66 on the fire truck pumps the admixture to hose 50. Hose 50 passes through an aperture 70 in a wall of the fire truck. A nozzle 72 can be connected to an end of hose 50 to enable an efficient distribution of the admixture of super absorbent polymer and water to an area containing a fire. The nozzle 72 and end of hose 50 are passed down through a manhole 22.

Figure 5:
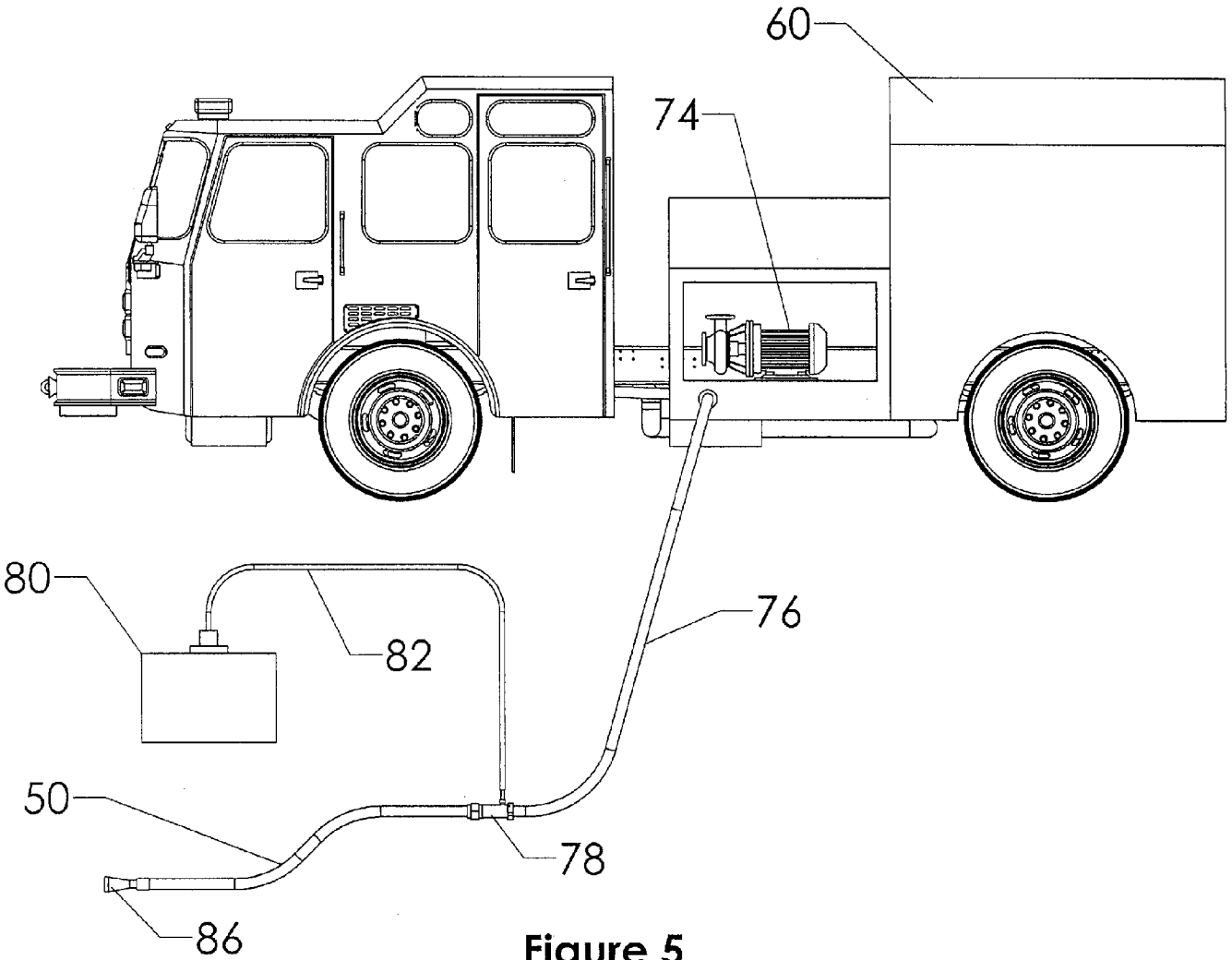
FIG. 5 is a fire truck connected to a fire hydrant and employing a separate supply of super absorbent polymer and an eductor.

In the embodiment of the present invention illustrated in FIG. 5, a fire truck 60 contains a supply of water in a tank on board the fire truck. The water is pumped from the truck by a pump 74 through hose 76 to an eductor 78. A container 80 holds a supply of solid super absorbent polymer. A hose 82 delivers the solid super absorbent polymer from container 80 to the eductor 78. The admixture of super absorbent polymer and water is then passed through hose 50 to a desired destination as a continuous process. A nozzle 86 can be secured to hose 50 so that the admixture can be delivered directly to the fire. Alternatively, hose 50 can be extended through a manhole so that the admixture can be delivered to an underground tunnel, as illustrated in FIGS. 1A and B.

The truck 54 illustrated in FIG. 7 is a truck which is used in a clean up operation after the fire has been extinguished. The truck has a source of vacuum 55F on board. This source of vacuum is normally a vacuum pump. A hose 52, illustrated in FIG. 2, is fluidly connected to a tank 55 on the truck 54. Debris from the fire is deposited and retained within tank 55 so that it can be removed from the site of the fire and processed for proper disposal.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A method of extinguishing and suppressing the spread of an electrical fire comprising:

adding a predetermined amount of solid super absorbent polymer to a predetermined amount of water to obtain an admixture;

applying said admixture to an electrical fire in an amount sufficient to extinguish said electrical fire and suppress the spread of said electrical fire;

said admixture entrapping particulates from said electrical fire and noxious gases; and removing a combination of said admixture and particulates and noxious gases entrained in said admixture from said electrical fire by applying a vacuum removal system to said combination of said admixture and particulates and noxious gases entrained in said admixture from said electrical fire.

2. The method of extinguishing and suppressing the spread of an electrical fire of claim 1 wherein said predetermined amount of solid super absorbent polymer is added to said predetermined amount of water in a batch process.

3. The method of extinguishing and suppressing the spread of an electrical fire of claim 1 wherein said predetermined amount of solid super absorbent polymer is added to said predetermined amount of water in a continuous process.

4. The method of extinguishing and suppressing the spread of an electrical fire of claim 2 wherein said electrical fire is in an underground tunnel containing electrical utilities, and said step of applying said admixture is from a position above said underground tunnel.

5. The method of extinguishing and suppressing the spread of an electrical fire of claim 4 wherein said step of applying said admixture to said electrical fire comprises completely or partially filling said underground tunnel with said admixture to a level sufficient to extinguish said electrical fire and suppress the spread of said electrical fire.

6. The method of extinguishing and suppressing the spread of an electrical fire of claim 1 wherein said predetermined amount of solid super absorbent polymer is added to said predetermined amount of water in a vehicle to obtain said admixture.

* * * * *